United States Patent [19]

Schweitzer

[11] Patent Number: 4,629,397

[45] Date of Patent: Dec. 16, 1986

[54] STRUCTURAL COMPONENT FOR USE UNDER HIGH THERMAL LOAD CONDITIONS

[75] Inventor: Klaus Schweitzer, Niederpoecking, Fed. Rep. of Germany

[73] Assignee: MTU Motoren-und Turbinen-Union Muenchen GmbH, Munich, Fed. Rep. of Germany

[21] Appl. No.: 627,291

[22] Filed: Jul. 2, 1984

[30] Foreign Application Priority Data

Jul. 28, 1983 [DE] Fed. Rep. of Germany ..... 3327218

[51] Int. Cl.[4] ..... F01D 5/18; B32B 7/00

[52] U.S. Cl. ..... 416/96 R; 416/241 B; 415/115; 165/907; 244/117 A; 428/608; 428/632; 60/267

[58] Field of Search ..... 416/241 B, 96 R, 97 A, 416/95, 96 A, 97 R; 428/608, 632; 415/115; 165/DIG. 10, 180, 133; 244/117 A, 158 A; 60/267,.730, 753, 754

[56] References Cited

U.S. PATENT DOCUMENTS

| | | | |
|---|---|---|---|
| 3,032,316 | 5/1962 | Kramer | 416/241 B |
| 3,114,612 | 12/1963 | Friedrich | 428/937 |
| 3,215,511 | 11/1965 | Chisholm et al. | 416/241 B |
| 4,042,162 | 8/1977 | Meginnis et al. | 416/96 R |
| 4,075,364 | 2/1978 | Panzera | 428/621 |
| 4,141,802 | 2/1979 | Duparque et al. | 428/608 |
| 4,199,937 | 4/1980 | Fortini et al. | 60/267 |
| 4,338,380 | 7/1982 | Erickson et al. | 428/608 |
| 4,492,522 | 1/1985 | Rossmann et al. | 416/241 B |

FOREIGN PATENT DOCUMENTS

| | | | |
|---|---|---|---|
| 2503285 | 7/1976 | Fed. Rep. of Germany . | |
| 2463849 | 2/1981 | France | 416/97 R |
| 0656503 | 8/1951 | United Kingdom | 416/241 B |
| 0778672 | 7/1957 | United Kingdom | 416/241 B |
| 0783710 | 9/1957 | United Kingdom | 416/241 B |

OTHER PUBLICATIONS

Nichols and Hanink, "Protective Coating for Turbine Parts," Mechanical Engineering, (Mar. 1965), pp. 53-59.

*Primary Examiner*—Robert E. Garrett
*Assistant Examiner*—H. Edward Li
*Attorney, Agent, or Firm*—W. G. Fasse; D. H. Kane, Jr.

[57] ABSTRACT

A structural component which is coolable for use under high thermal load conditions, such as a turbine blade, has a metallic support core with cooling ducts separated by lands in its surface. The core and its cooling ducts and lands are enclosed by an inner layer of metal felt and an outer layer of heat insulating ceramic material which partially penetrates into the metal felt to form a bonding zone between the felt and the ceramic material. Thus, any heat passing through the ceramic layer is introduced into the large surface area of the metal felt enabling the latter to efficiently introduce the heat into a cooling medium flowing in the ducts, thereby preventing thermal loads from adversely affecting the metal core to any appreciable extent.

16 Claims, 3 Drawing Figures

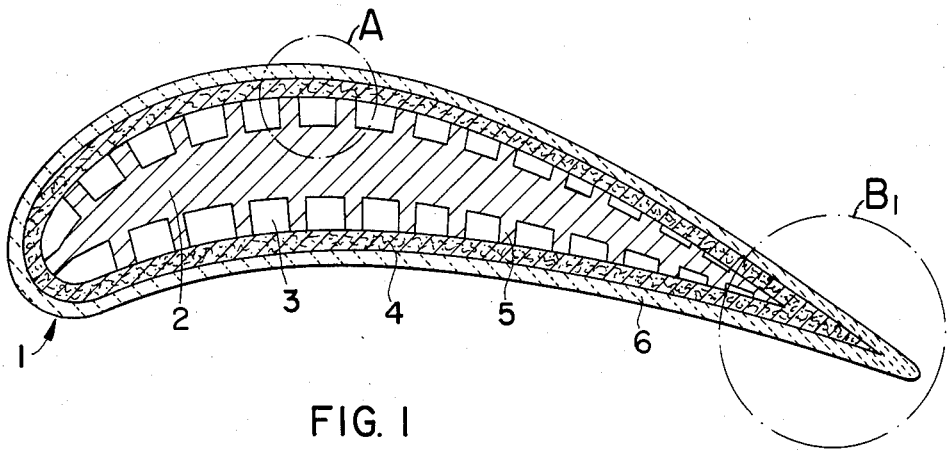
FIG. 1
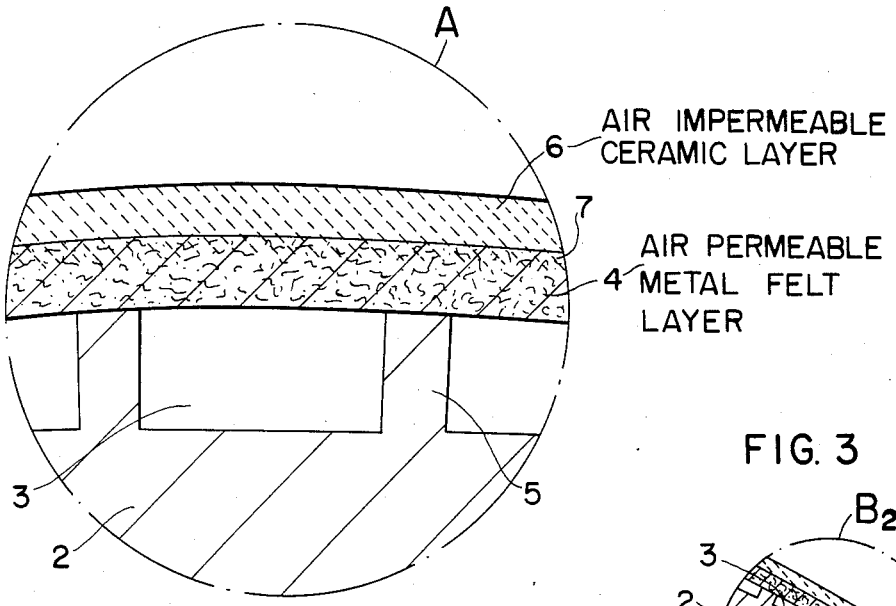
FIG. 2
FIG. 3
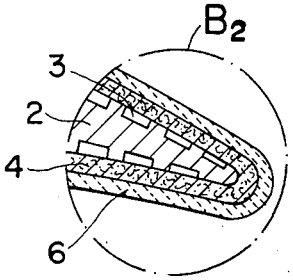

STRUCTURAL COMPONENT FOR USE UNDER HIGH THERMAL LOAD CONDITIONS

FIELD OF THE INVENTION

The invention relates to a coolable structural component such as a turbine blade, for use under high thermal load conditions. Such components, especially turbine blades have a supporting metal core provided in its surface with integral coolant guide ducts separated by lands and surrounded by a heat insulating jacket.

DESCRIPTION OF THE PRIOR ART

In recent times ever increasing requirements have been made with regard to the operating temperatures of thermal prime movers. On the other hand, materials suitable for handling such ever increasing temperatures have not been found to a satisfactory extent, since available materials do not have the required strength and/or durability for operation under such extremely high operating temperatures. Therefore, it has been customary to cool such structural components which are exposed to extremely high operating temperatures, for example, turbine blades of gas turbines. Special cooling devices are required in any event in order to assure that these structural components are maintained in a permissible temperature range or at a permissible temperature level.

Among other prior art approaches to the construction of the cooling devices, it is also known to provide structural components intended for use under high thermal load operating conditions with porous surfaces. A cooling medium such as air flows from an inner hollow space out of the component through these porous surfaces to provide a cooling boundary layer on the surface of the structural component. This type of cooling approach is known as so-called effusion cooling, please see in this connection the German Patent Publication (DE-OS) No. 2,503,285. In this reference the lands of the supporting core which form the cooling duct and the external heat insulating jacket are formed as an integral component by casting which is rather expensive because of the complicated shapes that must be cast. As a result, this type of protection is rather expensive. Another disadvantage of this prior art structure is seen in the high through-flow resistance which the cooling air encounters as it flows from the inside of the structural component to its outer surface. Yet another disadvantage is the large quantity of cooling air needed for an effective cooling of the outer jacket surface.

OBJECTS OF THE INVENTION

In view of the above, it is the aim of the invention to achieve the following objects singly or in combination:

to simplify the structural features of a structural component which is coolable for use under high thermal load conditions;

to construct such a component in such a way that it can be efficiently cooled, specifically by an effective heat transfer from the external heat insulating jacket to the cooling medium flowing below the heat insulating jacket;

to avoid the above mentioned effusion type cooling and thereby reduce the quantity of cooling medium needed for an effective cooling; and to withdraw any heat passing through the heat insulating outer jacket substantially directly from the jacket for direct transfer to the cooling medium.

SUMMARY OF THE INVENTION

According to the invention there is provided a structural component such as a turbine blade for use under high thermal load conditions which is provided with a thermal insulating jacket surrounding a supporting metal core in the surface of which there are integral cooling ducts separated by lands between adjacent cooling ducts. The heat insulating jacket comprises a first layer of metal felt which is secured on its core facing side to the lands of the core and which is intimately bonded on its outer surface to a heat insulating layer of ceramic material.

The ducts for the cooling medium, such as cooling air, are preferably formed simultaneously with the casting of the metallic support core or they may be machined into the cast core in a subsequent milling operation or spark erosion operation or a chemical erosion operation. In an advantageous and preferable manner, the metal felt layer is secured to the lands between adjacent cooling air ducts either by soldering, brazing, welding, or adhesive bonding.

The metal felt layer is preferably made of an alloy having high temperature resistance and high corrosion resistance characteristics. Alloys suitable for this purpose include nickel and/or cobalt base alloys, such as nickel chromium alloys, nickel chromium aluminum alloys, so-called Hastelloy X (which is a Registered Trademark), nickel chromium aluminum yttrium alloys, and cobalt chromium aluminum yttrium alloys, or nickel-cobalt chromium aluminum yttrium alloys.

The metal felt layer constitutes an elastical carrier material for the heat insulating layer of ceramic material which may be secured or applied to the metal felt layer in different ways. It has been found that an especially good bonding is provided between the metal felt layer and the heat insulating layer of ceramic material if the ceramic material penetrates at least partially into the interstices in the metal felt layer to thereby form a bonding zone between the metal felt layer and an outer compact layer of ceramic material which forms the heat insulating layer proper.

The penetration of the ceramic material into the outer surface zone of the metal felt layer and the application of the heat insulating layer of ceramic material may be accomplished by a thermal spraying or by a combined slurry dipping and sintering operation. The same results may be accomplished by a chemical vapor deposition of the ceramic material onto the metal felt.

Preferably, or suitably, the layer of ceramic material should be made of partially or fully stabilized zirconium oxide. Incidentally, the application of the layer of ceramic material may be accomplished by any combination of the above mentioned possibilities, all of which are well known in the art.

The outer surface of the heat insulating layer of ceramic material is preferably, or suitably, polished and/or it may have an aerodynamic shape for the intended turbine blade purposes.

BRIEF FIGURE DESCRIPTION

In order that the invention may be clearly understood, it will now be described, by way of example, with reference to the accompanying drawings, wherein:

FIG. 1 shows a sectional view through a turbine blade constructed according to the invention;

FIG. 2 is an enlarged view of the portion A encircled by dash-dotted lines in FIG. 1; and FIG. 3 shows a sectional view through a modified trailing edge of a turbine blade according to the invention.

DETAILED DESCRIPTION OF PREFERRED EXAMPLE EMBODIMENTS AND OF THE BEST MODE OF THE INVENTION

FIG. 1 shows schematically a sectional view through a turbine blade 1 having a supporting metal core 2 surrounded, according to the invention, by a first metal felt layer 4 which in turn is surrounded by a heat insulating second layer 6 made of a ceramic material. The metal felt layer 4 and the heat insulating ceramic layer 6 form a compound outer jacket to be described in more detail below. This jacket is rigidly secured to lands 5 separating unobstructed cooling ducts 3 in the surface of the core 2, whereby the metal felt layer 4 spaces the ceramic layer 6 from the lands 5, as shown in the drawings.

The trailing edge B1 shown in FIG. 1 has a fairly pointed shape, whereby the edge itself is mostly formed by the metal felt and the ceramic layer.

The support core 2 of metal is preferably cast of a nickel base alloy, whereby the cooling ducts 3 are preferably formed simultaneously with the casting operations. The metal felt layer 4 is rigidly secured to the outwardly facing surfaces of the lands 5 by soldering, brazing, welding, or by an adhesive bond. An adhesive material suitable for this purpose is, for example, ceramic cement based on water glass or phosphates with or without ceramic ($Al_2O_3$;$SiO_2$) or metallic (Al) filler material.

The metal felt itself is manufactured, for example, from a nickel and/or cobalt chromium aluminum alloy and forms an elastic carrier for the outer heat insulating ceramic layer 6. Due to the felt structure, a large surface is provided for the optimal heat conduction of any heat that may pass through the heat insulating ceramic layer 6, thereby effectively transmitting such heat directly to a cooling medium such as air flowing in the ducts 3.

The outer heat insulating ceramic layer 6 of ceramic material is made of partially or fully stabilized zirconium oxide, whereby a good anchoring of the heat insulating ceramic layer 6 to the metal felt layer 4 is accomplished by a partial penetration or infiltration of the ceramic material into the interstices of the felt material, thereby forming a bonding zone 7 as shown in FIG. 2 between the ceramic layer 6 and the felt layer 4. Good penetration or infiltration of the ceramic material into the top surface of the felt layer have been achieved by a chemical vapor deposition. Such vapor deposition or other type of application of the ceramic material will be continued until the desired thickness of the ceramic layer 6 outside of the bonding zone 7 is accomplished.

The advantage of the invention is seen in that the heat to which the structural component is exposed during its operational use does not need to flow through the entire structural component. Rather, the heat is transmitted to the cooling medium flowing in the ducts 3 along the shortest possible path, whereby the heat flow is kept as small as possible due to the low heat conductivity of the ceramic layer 6. These features in combination have the advantage that the quantity of cooling air required has been substantially reduced as compared to the prior art, even under operating conditions where the temperature of the gas flowing through the gas turbine is higher than heretofore.

The metal felt layer 4 is easily deformable and it is manufactured of a heat resistant nickel base alloy, for example, a nickel and/or cobalt chromium aluminum alloy suitable for making metal felts. Due to the deformability of such felts, the layer 4 closely hugs the surface of the metal core 2 to which the layer 4 is soldered or otherwise secured as described above. Furthermore, such felt layer has the advantage that it permits the application of a very dense and relatively thick ceramic layer as compared to prior art ceramic layers which have been directly applied to the surface of the solid metal core or substrate. Yet another advantage of the deformability of the intermediate metal felt layer 4 is seen in that any thermal expansion between the metal core 2 and the ceramic layer 6 is taken up by the easy deformability of the metal felt layer 4 so that the formation of impermissibly high stress thermal loads for the ceramic layer is avoided.

Compared to the trailing edge B1 shown in FIG. 1, the trailing edge B2 shown in FIG. 3 is more rounded so that the cooling ducts 3 may be located more closely to the edge proper. Otherwise, the trailing edge B2 is quite similar in its structure to the trailing edge B1 which is more pointed than the edge B2.

The just described features applied in combination make it possible to realize the advantages of the effusion cooling while actually avoiding an effusion cooling and thus also avoiding the need for moving large quantities of cooling air due to the use of a heat insulating ceramic layer which provides for a very effective heat transfer due to the intermediate metal felt layer 4 which has a large surface for this purpose, thereby permitting an optimal heat transfer. The heat transfer is optimal because any heat penetrating the heat insulating ceramic layer 6 is transmitted on the shortest possible path to the cooling medium without ever reaching the metal core 2. As a result, the core 2 which takes up the mechanical loads of the high load structural component remains relatively cool. The invention not only saves cooling air by reducing the required cooling air quantity, it also improves the thermodynamic efficiency of the structural component. Moreover, the density of the ceramic layer can be larger than heretofore, due to the intermediate metal felt layer as compared to applying the ceramic coating directly to a metal surface. As a result, the invention achieves excellent heat insulating characteristics for such structural components as gas turbine blades and the like.

Although the invention has been described with reference to specific example embodiments, it will be appreciated, that it is intended, to cover all modifications and equivalents within the scope of the appended claims.

What is claimed is:

1. A structural component for use under high thermal load conditions, comprising a supporting metal core, unobstructed cooling ducts integrally formed in the surface of said metal core for guiding a cooling medium inside said cooling ducts, lands in the surface of said metal core for separating said cooling ducts from one another, a first heat conducting layer (4) of a metal felt covering said lands and ducts for enclosing said metal core, said metal felt layer providing for an effective heat conduction all around said metal core, means securing said metal felt to said lands of said metal core, and a second outer layer (6) of ceramic material intimately bonded to said first layer (4) of metal felt, said metal felt layer spacing said ceramic layer from said lands for guiding said cooling medium uniformly into heat exchange contact with the entire inner surface of said ceramic material of said second layer (6) which encloses said structural component as a heat insulating ceramic layer, whereby any heat from said heat insulating layer is conducted efficiently into said cooling ducts for a uniform cooling avoiding thermal stress in said ceramic material.

2. The structural component of claim 1, wherein said securing means comprise a solder for securing said metal felt to said lands.

3. The structural component of claim 1, wherein said securing means comprise a welding for securing said metal felt to said lands.

4. The structural component of claim 1, wherein said securing means comprise an adhesive for securing said metal felt to said lands.

5. The structural component of claim 1, wherein said metal felt is made of a high temperature resistant and corrosion resistant alloy.

6. The structural component of claim 5, wherein said alloy is a nickel alloy.

7. The structural component of claim 5, wherein said alloy is a cobalt alloy.

8. The structural component of claim 5, wherein said alloy is a nickel and cobalt alloy.

9. The structural component of claim 1, wherein said second layer of ceramic material partially penetrates into said first layer of metal felt for forming an intimate bonding zone between the first and second layers.

10. The structural component of claim 9, wherein said int ate bonding zone and said second layer of ceramic material are formed by thermal spraying of the ceramic material onto the first layer of metal felt.

11. The structural component of claim 9, wherein said intimate bonding zone and said second layer of ceramic material are formed by a combination of slurry dipping and sintering the ceramic material into said metal felt in said bonding zone.

12. The structural component of claim 9, wherein said intimate bonding zone and said second layer of ceramic material are formed by a chemical deposition out of a vapor phase.

13. The structural component of claim 1, wherein said heat insulating ceramic layer has a polished outer surface.

14. The structural component of claim 1, wherein said heat insulating ceramic layer has an aerodynamic shape.

15. The structural component of claim 1, wherein said heat insulating ceramic layer has an aerodynamic shape, the surface of which is polished.

16. The structural component of claim 1, wherein said heat insulating ceramic layer is made of zirconium oxide which is partially or fully stabilized.

* * * * *